US009763475B2

(12) United States Patent
Liu

(10) Patent No.: US 9,763,475 B2
(45) Date of Patent: Sep. 19, 2017

(54) ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 804 days.

(21) Appl. No.: 13/968,399

(22) Filed: Aug. 15, 2013

(65) Prior Publication Data

US 2015/0013700 A1 Jan. 15, 2015

(30) Foreign Application Priority Data

Jul. 9, 2013 (CN) ..... 2013 2 0422809 U

(51) Int. Cl.
*A24F 47/00* (2006.01)

(52) U.S. Cl.
CPC ..... *A24F 47/008* (2013.01)

(58) Field of Classification Search
CPC ..... A24F 47/00
See application file for complete search history.

(56) References Cited

U.S. PATENT DOCUMENTS 8,402,976 B2 * 3/2013 Fernando ..... A24F 47/008 131/194
2005/0016553 A1 * 1/2005 Iannuzzi ..... A24F 47/002 131/273
2005/0121047 A1 * 6/2005 Saoud ..... A24B 15/28 131/364
2009/0095312 A1 * 4/2009 Herbrich ..... A61M 11/041 131/273
2013/0037041 A1 * 2/2013 Worm ..... A24F 47/008 131/329
2013/0160765 A1 * 6/2013 Liu ..... A24F 47/008 128/202.21
2013/0319436 A1 * 12/2013 Liu ..... A24F 47/008 131/329
2014/0048086 A1 * 2/2014 Zhanghua ..... A24F 47/008 131/329

* cited by examiner

*Primary Examiner* — Cynthia Szewczyk
(74) *Attorney, Agent, or Firm* — Matthias Scholl, PC; Matthias Scholl

(57) ABSTRACT

An electronic cigarette including a mouthpiece, a bracket for the mouthpiece, an atomization pole including a threaded copper ring, a silicate ring, a heating wire, a joint, an insulating ring, a filter cotton, and a fluid stop ring. The mouthpiece is made of silica gel and is connected with the atomization pole via the bracket. The heating wire is electrically welded using nickel-chrome as a material. The heating wire is spiral. One end of the threaded copper ring is connected with the joint. The insulating ring is disposed between the thread ring and the joint. The silicate ring is disposed between the filter cotton and the threaded copper ring. The fluid stop ring is disposed between the bracket and the heating wire for preventing the leakage of fluid.

2 Claims, 3 Drawing Sheets

ELECTRONIC CIGARETTE

CROSS-REFERENCE TO RELATED APPLICATIONS

Pursuant to 35 U.S.C. §119 and the Paris Convention Treaty, this application claims the benefit of Chinese Patent Application No. 201320422809.4 filed Jul. 9, 2013, the contents of which, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates to an electronic cigarette.

Description of the Related Art

It is well-known that smoking is harmful to health, but there are still hundreds of millions of smokers in the world, and the trend is expanding. To purify the environment, prohibition of smoking in public places has become the consensus. Thus, cigarette substitutes, such as patches for quitting smoking, nicotine mouthwash, nicotine gum, nicotine drink, flourish in the market. Although the cigarette substitutes cause no tar harm, nicotine is slowly absorbed in the blood and thus an effective peak concentration of nicotine cannot be established, so the "satisfied" feeling resulting from the high concentration of tobacco alkali cannot be achieved. Meanwhile, the smokers are deprived of the smoking actions such as pumping, exhaling, and puffing by consuming cigarette substitutes.

SUMMARY OF THE INVENTION

In view of the above-described problems, it is one objective of the invention to provide an electronic cigarette that is convenient for use and causes no pollution. When consuming the electronic cigarette, an enjoyable experience resulting from the smoking actions such as "pumping", "exhaling", and "puffing" can be achieved.

To achieve the above objective, in accordance with one embodiment of the invention, there is provided an electronic cigarette, comprising a mouthpiece, a bracket for the mouthpiece, an atomization pole comprising a threaded copper ring, a silicate ring, a heating wire, a joint, an insulating ring, a filter cotton, and a fluid stop ring. The mouthpiece is made of silica gel and is connected with the atomization pole via the bracket. The heating wire is electrically welded using nickel-chrome as a material. The heating wire is spiral; one end of the threaded copper ring is connected with the joint. The insulating ring is disposed between the thread ring and the joint. The silicate ring is disposed between the filter cotton and the threaded copper ring. The fluid stop ring is disposed between the bracket and the heating wire for preventing the leakage of fluid.

In a class of this embodiment, the heating wire comprises nickel-chrome and copper.

Advantages of the invention are summarized as follows:

1) the silicate ring is disposed between the filter cotton and the threaded copper ring, which tightly fixes the electronic cigarette; and 2) the heating wire comprises nickel-chrome and copper, which enhances the heat dissipation capability.

BRIEF DESCRIPTION OF THE DRAWINGS

The invention is described hereinbelow with reference to accompanying drawings, in which.

DETAILED DESCRIPTION OF THE EMBODIMENTS

Figure 1:
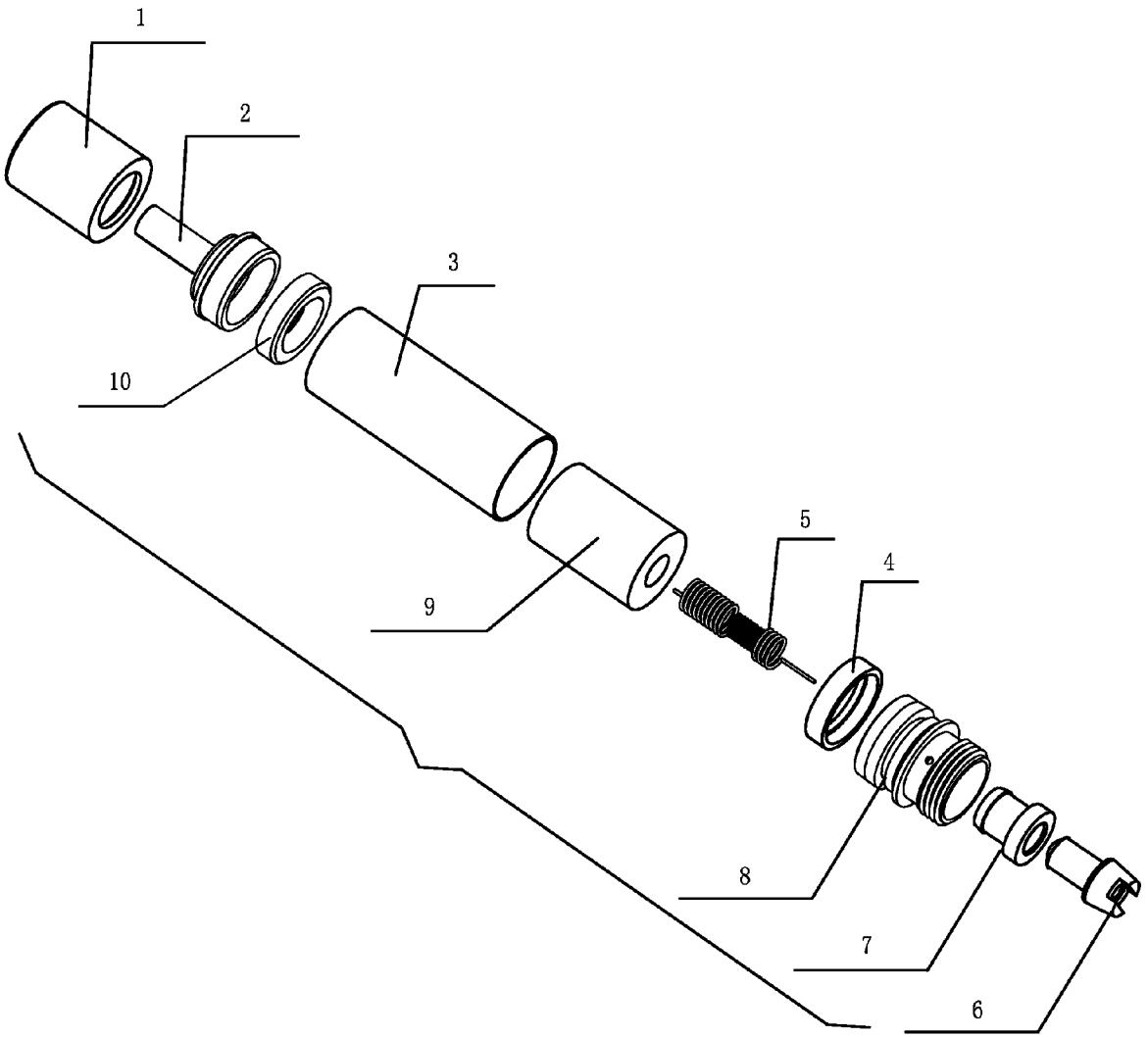
FIG. 1 is an exploded view of an electronic cigarette of the invention.
Figure 2:
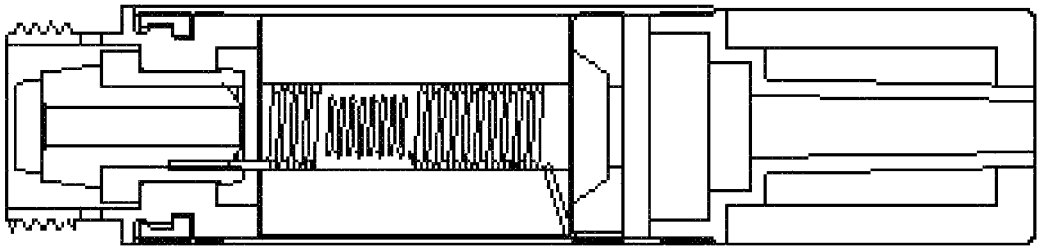
FIG. 2 is a schematic diagram of an electronic cigarette of the invention.
Figure 3:
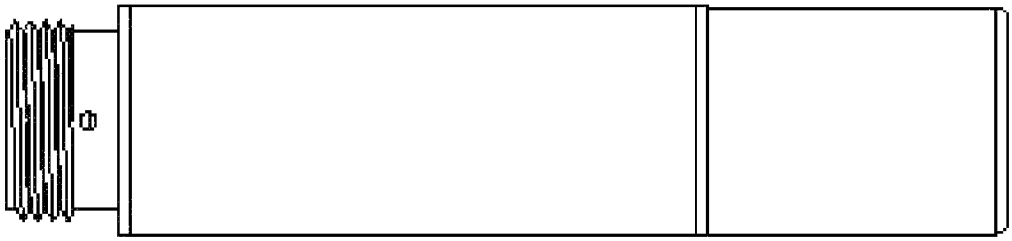
FIG. 3 is a sectional view of an electronic cigarette of the invention.

As shown in FIGS. 1, 2 and 3, an electronic cigarette, comprises a mouthpiece 1, a bracket 2 for the mouthpiece, an atomization pole 3 comprising a threaded copper ring 8, a silicate ring 4, a heating wire 5, a joint 6, an insulating ring 7, a filter cotton 9, and a fluid stop ring 10. The mouthpiece 1 is made of silica gel and is connected with the atomization pole 3 via the bracket 2. The heating wire 5 is electrically welded using nickel-chrome as a material. The heating wire 5 is spiral; one end of the threaded copper ring 8 is connected with the joint 6. The insulating ring 7 is disposed between the thread ring 8 and the joint 6. The silicate ring 4 is disposed between the filter cotton 9 and the threaded copper ring 8. The fluid stop ring 10 is disposed between the bracket 2 and the heating wire 5 for preventing the leakage of fluid.

Preferably, the heating wire comprises nickel-chrome and copper.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

a) a mouthpiece;

b) a bracket;

c) an atomization pole comprising a threaded copper ring;

d) a silicate ring;

e) a heating wire;

f) a joint;

g) an insulating ring;

h) a filter cotton comprising an inner wall, the inner wall defining an inner cavity; and i) a fluid stop ring;

wherein:

the mouthpiece is made of silica gel and is connected with the atomization pole via the bracket;

the heating wire is electrically welded using nickel-chrome as a material;

the heating wire is spiral;

the heating wire is disposed inside the inner cavity of the filter cotton and is in direct contact with the inner wall of the filter cotton;

the heating wire is wound into a hollow cylinder and the hollow cylinder is substantially coaxial with the filter cotton;

one end of the threaded copper ring is connected with the joint;

the insulating ring is disposed between the threaded copper ring and the joint;

the silicate ring is disposed between the filter cotton and the threaded copper ring; and the fluid stop ring is disposed between the bracket and the heating wire for preventing the leakage of fluid.

2. The electronic cigarette of claim 1, wherein the heating wire comprises nickel-chrome and copper.

* * * * *